US008178270B2

(12) United States Patent
Shiokawa

(10) Patent No.: US 8,178,270 B2
(45) Date of Patent: May 15, 2012

(54) TONER FOR DEVELOPMENT OF ELECTROSTATIC IMAGE

(75) Inventor: Kazuya Shiokawa, Tokyo (JP)

(73) Assignee: Zeon Corporation, Tokyo (JP)

( * ) Notice: Subject to any disclaimer, the term of this patent is extended or adjusted under 35 U.S.C. 154(b) by 717 days.

(21) Appl. No.: 12/306,441

(22) PCT Filed: Jun. 19, 2007

(86) PCT No.: PCT/JP2007/062652

§ 371 (c)(1),
(2), (4) Date: Dec. 23, 2008

(87) PCT Pub. No.: WO2008/001702

PCT Pub. Date: Jan. 3, 2008

(65) Prior Publication Data

US 2009/0280422 A1 Nov. 12, 2009

(30) Foreign Application Priority Data

Jun. 30, 2006 (JP) ..... 2006-180621
Aug. 3, 2006 (JP) ..... 2006-212582

(51) Int. Cl.
*G03G 9/097* (2006.01)

(52) U.S. Cl. ..... 430/108.21; 430/108.2; 430/108.6

(58) Field of Classification Search ..... 430/108.21, 430/108.2, 108.6
See application file for complete search history.

(56) References Cited

U.S. PATENT DOCUMENTS

| | | | | |
|---|---|---|---|---|
| 7,309,558 | B1 * | 12/2007 | Michel et al. | 430/137.1 |
| 2007/0218380 | A1 * | 9/2007 | Uchinokura et al. | 430/108.1 |
| 2007/0218382 | A1 * | 9/2007 | Emoto et al. | 430/108.1 |
| 2008/0076054 | A1 * | 3/2008 | Nozaki et al. | 430/110.2 |
| 2008/0107986 | A1 * | 5/2008 | Michel et al. | 430/84 |
| 2008/0227013 | A1 * | 9/2008 | Kadota et al. | 430/108.15 |
| 2008/0233498 | A1 * | 9/2008 | Yamada et al. | 430/48 |
| 2008/0311500 | A1 * | 12/2008 | Yamada et al. | 430/105 |
| 2009/0047591 | A1 * | 2/2009 | McDougall et al. | 430/109.3 |
| 2009/0117482 | A1 * | 5/2009 | Shirai et al. | 430/108.23 |
| 2009/0214975 | A1 * | 8/2009 | Awamura et al. | 430/113 |
| 2009/0280422 | A1 * | 11/2009 | Shiokawa | 430/108.2 |

FOREIGN PATENT DOCUMENTS

| | | | |
|---|---|---|---|
| EP | 1496401 | A1 | 1/2005 |
| JP | 54-028630 | A | 3/1979 |
| JP | 2-000876 | A | 1/1990 |
| JP | 3-100661 | A | 4/1991 |
| JP | 5-158276 | A | 6/1993 |
| JP | 8-286419 | A | 11/1996 |
| JP | 2000-35694 | A | 2/2000 |
| JP | 2003-515795 | A | 5/2003 |
| JP | 2003-202708 | A | 7/2003 |
| JP | 2004-309718 | A | 11/2004 |
| JP | 2005-292422 | A | 10/2005 |
| JP | 2006-113616 | A | 4/2006 |
| JP | 2006-163149 | A | 6/2006 |
| WO | WO 2005111729 | A2 * | 11/2005 |
| WO | WO 2007018125 | A1 * | 2/2007 |

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

International Search Report of PCT/JP2007/062652, Mailing Date of Jul. 24, 2007.

European Search Report dated Feb. 1, 2012, issued in corresponding European Patent Application No. 07767460.4.

* cited by examiner

*Primary Examiner* — Christopher Rodee

(74) *Attorney, Agent, or Firm* — Westerman, Hattori, Daniels & Adrian, LLP

(57) ABSTRACT

A toner for development of electrostatic images, comprising colored resin particles containing a binder resin and a colorant, and an external additive, wherein the external additive contains fine particles of an inorganic layered clay compound, and the inorganic layered clay compound is an intercalation compound with a quaternary ammonium ion intercalated between layers of the inorganic layered clay compound or has an interlayer distance of 1.5 to 4 nm.

7 Claims, No Drawings

TONER FOR DEVELOPMENT OF ELECTROSTATIC IMAGE

TECHNICAL FIELD

The present invention relates to a toner for development of electrostatic images, which is used for developing electrostatic images (electrostatic latent images) formed on a photosensitive member of an image forming apparatus making use of an electrophotographic system (including an electrostatic recording system), such as a copying machine, facsimile or printer.

BACKGROUND ART

In an image forming apparatus such as an electrophotographic apparatus or electrostatic recording apparatus, a printed image is generally formed in accordance with the following process.

An electrostatic latent image is first formed on a photosensitive member by conducting image exposure. The electrostatic latent image is then developed with a developer (toner) to form a visible image (toner image). The development of the electrostatic latent image is conducted by a method that a toner stored in a development unit is supplied on to the photosensitive member using a means such as a developing roll or developing belt. The toner image on the photosensitive member is transferred to any of various transfer media such as paper and OHP sheets as needed. The toner image on the transfer medium is fixed on to the transfer medium by a means such as heating, pressing or solvent vapor. On the other hand, the toner remaining on the photosensitive member without being transferred is removed by a cleaning means. A printed image is formed by such a series of operations. As the developer, is generally used a toner for development of electrostatic images (hereinafter may be referred to as "toner" merely) comprising, as a main component, colored resin particles containing a binder resin and a colorant.

In recent years, there has been strong need of forming color images in image forming apparatus using an electrophotographic system, such as copying machines, facsimiles and printers. In color printing, high resolution is required because printing of high-definition images such as photographs is also conducted. Therefore, color toners capable of forming a high-resolution and high-definition image are required.

In addition, reduction of printing cost is also required. Therefore, a toner is required not to lower print quality even when printing is conducted on a large number of sheets of paper, i.e., to have excellent printing durability. Further, the toner has recently been required to lower neither image quality nor printing durability even under a high-temperature and high-humidity environment.

As a method for coping with the above-described various requirements, it has heretofore been known to adding inorganic fine particles and/or organic fine particles having a particle diameter smaller than a particle diameter of colored resin particles to the colored resin particles so as to cause such fine particles to adhere to the surfaces of the colored resin particles. In other words, it is attempted to improve resolution and printing durability by externally adding the inorganic fine particles and/or organic fine particles to the colored resin particles which become a main component of a toner.

Japanese Patent Application Laid-Open No. 3-100661 discloses a toner obtained by externally adding fine silica particles having an average particle diameter of from 5 nm or more to less than 20 nm and fine titanium dioxide particles having an average particle diameter of from 20 nm or more to 40 nm or less in combination to spherical toner particles having an average particle diameter of from 2 to 6 μm (colored resin particles).

However, the toner obtained by externally adding the fine silica particles and fine titanium dioxide particles to the colored resin particles is improved in transferability, developability and cleaning ability, but lowered in flowability and easy to cause fog due to embedding of the external additives in the colored resin particles when a printing durability test is conducted on a large number of sheets of paper.

Japanese Patent Application Laid-Open No. 54-28630 proposes a toner obtained by externally adding silane-modified clay to toner particles (colored resin particles). This document shows clay modified with a silane coupling agent such as aminosilane or mercaptosilane.

Japanese Patent Application Laid-Open No. 5-158276 discloses a nonmagnetic one-component developer obtained by externally adding spherical fine powder made of glass having an average particle diameter of 1 to 50 μm to colored fine particles (colored resin particles). This document proposes externally adding colloidal silica or clay together with the spherical fine powder made of glass. Specifically, the document discloses, as the clay, kaolin clay (calcined clay), the surface of which has been subjected to a hydrophobilizing treatment with a silane coupling agent or silicone oil. The kaolin clay is a layered compound. However, when it is calcined, crystal water is lost to lose its layer structure.

The toner obtained by externally adding the silane-modified clay or the calcined clay subjected to the hydrophobilizing treatment to the colored resin particles is improved in printing durability to some extent. However, the improvement is insufficient to meet the requirement level in recent years, and so its charge level is lowered, and fog is easy to occur when a printing durability test is conducted under a high-temperature and high-humidity environment.

DISCLOSURE OF THE INVENTION

It is an object of the present invention to provide a toner for development of electrostatic images, which is hard to cause fog and excellent in printing durability not only under a normal-temperature and normal-humidity environment but also under a high-temperature and high-humidity environment.

Another object of the present invention is to provide a toner for development of electrostatic images, which is hard to cause fog even when printing is conducted on a large number of sheets of paper, and moreover is hard to cause blur and excellent in printing durability.

The present inventor has carried out an extensive investigation with a view toward achieving the above objects. As a result, it has been found that an intercalation compound, which is fine particles of an inorganic layered clay compound with a quaternary ammonium ion intercalated between layers thereof, is externally added, as an external additive, to colored resin particles, thereby obtaining a toner for development of electrostatic images, which is hard to cause fog and excellent in printing durability not only under a normal-temperature and normal-humidity environment but also under a high-temperature and high-humidity environment.

The present inventor has also found that fine particles, which are fine particles of an inorganic layered clay compound, whose interlayer distance is 1.5 to 4 nm, are externally added, as an external additive, to colored resin particles, thereby obtaining a toner for development of electrostatic images, which is hard to cause fog even when printing is conducted on a large number of sheets of paper, and moreover is hard to cause blur and excellent in printing durability.

According to the present invention, there is thus provided a toner for development of electrostatic images, comprising colored resin particles containing a binder resin and a colorant, and an external additive, wherein the external additive contains fine particles of an inorganic layered clay compound, and the inorganic layered clay compound is an intercalation compound with a quaternary ammonium ion intercalated between layers of the inorganic layered clay compound.

According to the present invention, there is also provided a toner for development of electrostatic images, comprising colored resin particles containing a binder resin and a colorant, and an external additive, wherein the external additive contains fine particles of an inorganic layered clay compound, and the interlayer distance of the inorganic layered clay compound is 1.5 to 4 nm.

In the present invention, the fine particles of the inorganic layered clay compound may preferably be an intercalation compound with a quaternary ammonium ion intercalated between layers of the inorganic layered clay compound, the surfaces of the fine particles being subjected to a hydrophobilizing treatment with a hydrophobilizing agent. The number average primary particle diameter of the fine particles of the inorganic layered clay compound may preferably be 0.1 to 10 μm. The inorganic layered clay compound may preferably be a clay of a smectite group. The inorganic layered clay compound having an interlayer distance of 1.5 to 4 nm may preferably be an intercalation compound with a quaternary ammonium ion intercalated between layers of the inorganic layered compound.

The colored resin particles used in the present invention may preferably further contain a charge control resin.

In the present invention, the external additive may preferably further contain fine particles (A) having a number average primary particle diameter of 3 to 18 nm and fine particles (B) having a number average primary particle diameter of 20 to 200 nm in addition to the fine particles of the inorganic layered clay compound. These fine particles (A) and (B) may preferably be, independently of each other, selected from fine silica particles and fine titanium oxide (titania) particles.

BEST MODE FOR CARRYING OUT THE INVENTION

The toner for development of electrostatic images according to the present invention and a production process thereof will hereinafter be described in detail.

The toner according to the present invention comprises colored resin particles and an external additive. The colored resin particles are particles containing a binder resin and a colorant and may further contain other additives such as a charge control agent, a parting agent and a pigment dispersant.

As specific examples of the binder resin, may be mentioned resins heretofore widely used as binder resins for toners, such as polystyrene, styrene-butyl acrylate copolymers, polyester resins and epoxy resins.

Examples of a production process of the colored resin particles include a pulverization process and a polymerization process. However, the production process is not limited to a specific production process. Colored resin particles obtained by melting and kneading a binder resin, a colorant and other additives, and pulverizing and classifying the resultant kneaded product in accordance with the pulverization process is called a pulverized toner.

Examples of the polymerization process include an emulsion polymerization aggregation process, a dispersion polymerization process and a suspension polymerization process. Among these processes, the suspension polymerization process is preferred. A toner obtained by the polymerization process is called a polymerized toner. The polymerized toner is preferred because it can be provided as colored polymer particles having a particle diameter of micron order and a relatively sharp particle diameter distribution.

In the suspension polymerization process, colored resin particles (colored polymer particles) are produced by subjecting a polymerizable monomer composition containing a polymerizable monomer, a colorant and other additives to suspension polymerization in an aqueous dispersion medium. More specifically, the following process is generally adopted when the colored resin particles are produced by the suspension polymerization process.

A polymerizable monomer, a colorant and optional other additives are first mixed to prepare a polymerizable monomer composition. After this polymerizable monomer composition is then poured into an aqueous medium containing a dispersion stabilizer as needed, and the resultant mixture is stirred to form droplets of the polymerizable monomer composition.

The polymerizable monomer composition is then polymerized to obtain an aqueous dispersion containing colored resin particles formed. This aqueous dispersion is washed, dehydrated and dried to obtain dried colored resin particles. After the dried colored resin particles are classified as needed, they are mixed with an external additive to obtain a toner for development of electrostatic images. This toner for development of electrostatic images is an one-component developer. When magnetic particles are not used as the colorant, this toner for development of electrostatic images is provided as a nonmagnetic one-component developer. When a carrier is further added to this toner, a two-component toner for development of electrostatic images is obtained.

When the colored resin particles (colored polymer particles) obtained by the suspension polymerization process are used as core particles, and a polymer layer (shell) is formed on the surfaces thereof, a core-shell type toner is obtained.

(1) Polymerizable Monomer Composition

The polymerizable monomer means a polymerizable compound. A monovinyl monomer is preferably used as a main component of the polymerizable monomer. Examples of the monovinyl monomer include styrene; styrene derivatives such as vinyltoluene and α-methylstyrene; α,β-unsaturated carboxylic acid such as acrylic acid and methacrylic acid; acrylates such as methyl acrylate, ethyl acrylate, propyl acrylate, butyl acrylate, 2-ethylhexyl acrylate and dimethylaminoethyl acrylate; methacrylates such as methyl methacrylate, ethyl methacrylate, propyl methacrylate, butyl methacrylate, 2-ethylhexyl methacrylate and dimethylaminoethyl methacrylate; derivatives of acrylic acid or methacrylic acid, such as acrylamide and methacrylamide; and olefins such as ethylene, propylene and butylene.

These monovinyl monomers may be used either singly or in any combination thereof. Among these monovinyl monomers, styrene, styrene derivatives and derivatives of acrylic acid or methacrylic acid are preferred.

The monovinyl monomer(s) may preferably be selected in such a manner that the glass transition temperature (Tg) of a polymer obtained by polymerizing it (them) is 80° C. or lower. The polymerizable monomers are used either singly or in combination of 2 or more monomers thereof, whereby the Tg of a polymer formed can be controlled within a desired range.

In order to improve hot offset, a crosslinkable polymerizable monomer (hereinafter referred to as "crosslinkable monomer") is preferably used as a part of the polymerizable monomer together with the monovinyl monomer. The crosslinkable monomer means a monomer having at least two polymerizable functional groups.

As examples of the crosslinkable monomer, may be mentioned aromatic divinyl compounds such as divinylbenzene, divinylnaphthalene and derivatives thereof; unsaturated polycarboxylic acid polyesters of polyhydric alcohols, such as ethylene glycol dimethacrylate and diethylene glycol dimethacrylate; other divinyl compounds such as N,N-divinylaniline and divinyl ether; and compounds having three or more vinyl groups. However, the crosslinkable monomer is not limited thereto. These crosslinkable monomers may be used either singly or in any combination thereof.

In the present invention, the crosslinkable monomer is desirably used in a proportion of generally 0.1 to 5 parts by weight, preferably 0.3 to 2 parts by weight per 100 parts by weight of the monovinyl monomer.

A macromonomer is preferably used as a part of the polymerizable monomer because a balance between shelf stability and low-temperature fixing ability of the resulting toner can be improved. The macromonomer is a compound having a polymerizable carbon-carbon unsaturated double bond at its molecular chain terminal and is generally a reactive oligomer or polymer having a number average molecular weight of 1,000 to 30,000. The macromonomer is preferably that giving a polymer having a Tg higher than the Tg of a polymer obtained by polymerizing the monovinyl monomer.

The amount of the macromonomer used is generally 0.01 to 10 parts by weight, preferably 0.03 to 5 parts by weight, more preferably 0.05 to 1 part by weight per 100 parts by weight of the monovinyl monomer.

In the present invention, the colored resin particles can be produced by using a desired colorant. When color toners are produced, generally, respective colorants of black, cyan, yellow and magenta are used. Other colorants, for example, white colorants such as titanium dioxide may also be used.

As black colorants, may be used colorants and dyes, such as carbon black, titanium black, oil black; and magnetic powders such as zinc iron oxide and nickel iron oxide.

As cyan colorants, may be used, for example, copper phthalocyanine compounds and derivatives thereof, and anthraquinone compounds. Specific examples of the cyan colorants include C.I. Pigment Blue: 1, 7, 15, 15:1, 15:2, 15:3, 15:4, 60, 62 and 66. However, the cyan colorants are not limited thereto.

As yellow colorants and magenta colorants, may be used compounds such as azo pigments such as mono-azo pigments and dis-azo pigments; and fused polycyclic pigments.

Specific examples of the yellow colorants include C.I. Pigment Yellow: 3, 12, 13, 14, 15, 17, 24, 60, 62, 65, 73, 74, 75, 83, 93, 97, 99, 100, 101, 104, 108, 117, 120, 123, 138, 139, 148, 150, 151, 154, 155, 156, 166, 169, 173, 175, 177, 179, 180, 181, 183, 185, 186, 191, 192, 193, 199 and 213.

Specific examples of the magenta colorants include C.I. Pigment Red: 2, 3, 5, 6, 7, 23, 31, 48:2, 48:3, 48:4, 57:1, 58, 60, 63, 64, 68, 81:1, 83, 87, 88, 89, 90, 112, 114, 122, 123, 144, 146, 149, 150, 163, 166, 169, 170, 177, 184, 185, 187, 202, 206, 207, 209, 220, 221, 251 and 254.

The amount of each colorant used is preferably 1 to 10 parts by weight per 100 parts by weight of the binder resin.

In order to improve a dispersed state of the colorant in the colored resin particles, it is preferable to treat the surface of the colorant with a pigment dispersant. As the pigment dispersant, is preferred a coupling agent such as an aluminum coupling agent, silane coupling agent or titanium coupling agent.

The colored resin particles preferably contain a charge control agent. When a negatively chargeable toner is produced, a negatively chargeable charge control agent is mainly used. When a positively chargeable toner is produced, a positively chargeable charge control agent is mainly used. A small amount of a charge control agent of a polarity reverse to the polarity of the charge control agent mainly used may also be used in combination.

Examples of the positively chargeable charge control agent include charge control resins such as polyamine resins, tertiary amino group-containing copolymers, quaternary ammonium salt group-containing copolymers; and besides imidazole compounds, nigrosine dyes, quaternary ammonium salts and triaminotriphenylmethane compounds.

Examples of the negatively chargeable charge control agent include charge control resins such as sulfonic group-containing copolymers, sulfonate group-containing copolymers, carboxyl group-containing copolymers and carboxylate group-containing copolymers; and besides azo dyes containing a metal such as Cr, Co, Al or Fe, salicylic acid metal compounds and alkylsalicylic acid metal compounds.

A charge control resin is preferably used as the charge control agent because the printing durability of the resulting toner is improved. The charge control agent is used in a proportion of preferably 0.01 to 30 parts by weight, more preferably 0.2 to 20 parts by weight per 100 parts by weight of the binder resin. When the charge control resin is used as the charge control agent, the charge control resin is used in a proportion of preferably 0.1 to 30 parts by weight, more preferably 0.3 to 20 parts by weight per 100 parts by weight of the binder resin.

As other additives, a parting agent is preferably added for improving the parting property of the resulting toner from a fixing roll upon fixing.

No particular limitation is imposed on the parting agent so far as it is that used as a parting agent for toners. Specific examples of the parting agent include low-molecular weight polyolefin waxes such as low-molecular weight polyethylene, low-molecular weight polypropylene and low-molecular weight polybutylene; terminal-modified polyolefin waxes such as molecular terminal-oxidized low-molecular weight polypropylene, terminal-modified low-molecular weight polypropylene with its molecular terminal substituted by an epoxy group, block polymers of these compounds with low-molecular weight polyethylene, molecular terminal-oxidized low-molecular weight polyethylene, low-molecular weight polyethylene with its molecular terminal substituted by an epoxy group, and block polymers of these compounds with low-molecular weight polypropylene; natural waxes such as candelilla wax, carnauba wax, rice wax, Japan wax and jojoba wax; petroleum waxes such as paraffin wax, microcrystalline wax and petrolatum, and modified waxes thereof; mineral waxes such as montan, ceresin and ozokerite; synthetic waxes such as Fischer-Tropsch wax; and polyhydric alcohol ester compounds, such as pentaerythritol esters such as pentaerythritol tetramyristate, pentaerythritol tetrapalmitate, pentaerythritol tetrastearate and pentaerythritol tetralaurate, and dipentaerythritol esters such as dipentaerythritol hexamyristate, dipentaerythritol hexapalmitate and dipentaerythritol hexylaurate.

Among these parting agents, the polyhydric alcohol ester compounds are preferred because the low-temperature fixing ability of the resulting toner is improved, and the printing durability thereof is not deteriorated. These parting agents may be used either singly or in any combination thereof.

The parting agent is used in a proportion of preferably 0.1 to 30 parts by weight, more preferably 1 to 20 parts by weight per 100 parts by weight of the monovinyl monomer.

As other additives, a molecular weight modifier is preferably used. Examples of the molecular weight modifier include mercaptan compounds such as t-dodecylmercaptan, n-dodecylmercaptan, n-octylmercaptan and 2,2,4,6,6-pentamethylheptane-4-thiol. The molecular weight modifier is used in a proportion of preferably 0.01 to 10 parts by weight, more preferably 0.1 to 5 parts by weight per 100 parts by weight of the monovinyl monomer.

(2) Formation of Droplets

In the suspension polymerization process, the polymerizable monomer composition is dispersed in an aqueous medium containing a dispersion stabilizer, an polymerization initiator is added, and droplets of the polymerizable monomer composition are then formed. No particular limitation is imposed on a method for forming the droplets. However, the formation is preferably conducted by means of, for example, a device capable of strongly stirring, such as an in-line type emulsifying and dispersing machine (manufactured by Ebara Corporation, trade name "MILDER") or a high-speed emulsifying and dispersing machine (manufactured by Tokushu Kika Kogyo Co., Ltd., trade name "T.K. HOMOMIXER MARK II").

The aqueous medium may be water alone. However, a solvent soluble in water, such as a lower alcohol or lower ketone, may also be used in combination with water.

A dispersion stabilizer is preferably contained in the aqueous medium. Examples of the dispersion stabilizer include metallic compounds, such as sulfates such as barium sulfate and calcium sulfate; carbonates such as barium carbonate, calcium carbonate and magnesium carbonate; phosphates such as calcium phosphate; metal oxides such as aluminum oxide and titanium oxide; and metal hydroxides such as aluminum hydroxide, magnesium hydroxide and ferric hydroxide.

Besides the metallic compounds, organic compounds, such as water-soluble polymers such as polyvinyl alcohol, methyl cellulose and gelatin; anionic surfactants; nonionic surfactants; and amphoteric surfactants may be mentioned as dispersion stabilizers. The dispersion stabilizers may be used either singly or in any combination thereof.

Among the dispersion stabilizers, dispersion stabilizers containing colloid of a metallic compound, particularly, a hardly water-soluble metal hydroxide, are preferred because the particle diameter distribution of the resulting colored resin particles can be narrowed, and the amount of the dispersion stabilizer remaining after washing can be lessened, and so the resulting polymerized toner can brightly or sharply reproduce images, and image quality under a high-temperature and high-humidity environment is not deteriorated in particular.

Examples of the polymerization initiator include inorganic persulfates such as potassium persulfate and ammonium persulfate; azo compounds such as 4,4'-azobis(4-cyanovaleric acid), 2,2'-azobis[2-methyl-N-(2-hydroxy-ethyl)propionamide], 2,2'-azobis(2-amidinopropane) dihydrochloride, 2,2'-azobis(2,4-dimethylvaleronitrile) and 2,2'-azobisisobutyronitrile; and organic peroxides such di-t-butyl peroxide, benzoyl peroxide, t-butyl peroxy-2-ethylhexanoate, t-hexyl peroxy-2-ethyl hexanoate, t-butyl peroxypivalate, diisopropyl peroxydicarbonate, di-t-butyl peroxyisophthalate and t-butyl peroxyisobutyrate. Among these, the organic peroxides are preferred because the amount of a residual unreacted polymerizable monomer can be lessened, and the printing durability of the resulting polymerized toner can be improved, with organic peroxy ester compounds being particularly preferred.

The polymerization initiator may be added into the aqueous medium after the polymerizable monomer composition is dispersed in the aqueous medium and before the droplets are formed. However, the polymerization initiator may also be added into the polymerizable monomer composition. In order to avoid premature polymerization, it is preferred that after the polymerizable monomer composition is dispersed in the aqueous medium, and the resultant mixture is stirred to form primary droplets having a volume average particle diameter of about 50 to 1,000 μm, the polymerization initiator is added to the aqueous medium, and the resultant mixture is stirred to form secondary droplets having a volume average particle diameter near to that of the intended colored polymer particles (colored resin particles). The polymerization initiator added to the aqueous medium migrates into the droplets of the polymerizable monomer composition in the droplet-forming step.

The amount of the polymerization initiator added is preferably 0.1 to 20 parts by weight, more preferably 0.3 to 15 parts by weight, particularly preferably 1.0 to 10 parts by weight per 100 parts by weight of the monovinyl monomer.

(3) Polymerization

After the droplets of the polymerizable monomer composition are formed in the aqueous medium, the aqueous medium is heated to initiate polymerization, thereby obtaining an aqueous dispersion containing colored resin particles (colored polymer particles) formed.

The polymerization temperature is preferably at least 50° C., more preferably 60 to 95° C. The polymerization is conducted for preferably 1 to 20 hours, more preferably 2 to 15 hours.

The colored resin particles formed by the polymerization with an external additive added thereto may be used as a toner for development of electrostatic images as they are. In order to improve low-temperature fixing ability and shelf stability (aggregation resistance), it is preferable to provide core-shell type colored resin particles by using the colored resin particles as core particles and forming a shell layer composed of a polymer component different from the binder resin component forming the core particles on the surfaces of the core particles. The core-shell type colored resin particles are formed by covering the core particles composed of a material having a low Tg with a material having a Tg higher than the core particles, whereby a balance between lowering of a fixing temperature (low-temperature fixing ability) and prevention of aggregation upon storage (shelf stability) can be taken.

No particular limitation is imposed on a process for producing the core-shell type colored resin particles, and any conventionally known process may be adopted. However, in-situ polymerization process and phase separation process are preferred from the viewpoint of production efficiency.

The production process of the core-shell type colored resin particles by the in-situ polymerization process will hereinafter be described.

A polymerizable monomer (polymerizable monomer for shell) for forming a shell layer and a polymerization initiator are added into an aqueous medium, in which the colored resin particles obtained by the polymerization process have been dispersed, and the polymerizable monomer for shell is polymerized, whereby a shell composed of a polymer layer can be formed on the surface of the colored polymer particles to become core particles.

The polymerizable monomer for shell may be selected from among the monovinyl monomers mentioned above. Among these, polymerizable monomers respectively forming polymers having a Tg exceeding 80° C., such as styrene, acrylonitrile and methyl methacrylate, are preferably used either singly or in combination of two or more monomers thereof. The Tg of the polymer forming the shell is preferably higher than the Tg of the polymer forming the core particles, more preferably higher by at least 5° C., particularly preferably higher by at least 10° C. The upper limit of the Tg of the polymer forming the shell is generally 110° C., often 105° C. The Tg of the polymer forming the core particles is generally at most 80° C., preferably 40 to 80° C., more preferably 50 to 70° C.

As examples of polymerization initiators used in the polymerization of the polymerizable monomer for shell, may be mentioned water-soluble polymerization initiators, such as metal persulfates such as potassium persulfate and ammonium persulfate; and azo type initiators such as 2,2'-azobis[2-methyl-N-(2-hydroxyethyl)propionamide] and 2,2'-azobis-[2-methyl-N-[1,1-bis(hydroxymethyl)-2-hydroxyethyl]-propionamide]. The amount of the polymerization initiator used is preferably 0.1 to 30 parts by weight, more preferably 1 to 20 parts by weight per 100 parts by weight of the polymerizable monomer for shell.

(4) Post-Treatment Step

After completion of the polymerization, the aqueous dispersion containing the colored resin particles (including the core-shell type colored resin particles) formed by the polymerization is subjected to a post-treatment of filtration, removal of the dispersion stabilizer, dehydration, washing in accordance with a method known per se in the art, thereby collecting colored resin particles.

When an inorganic compound such as an inorganic hydroxide is used as the dispersion stabilizer, a washing process preferably comprises a washing step (referred to as acid washing or alkali washing) of adding an acid or alkali to the aqueous dispersion, thereby dissolving the dispersion stabilizer in water to remove it. When colloid of a hardly water-soluble inorganic hydroxide is used as the dispersion stabilizer, an acid is preferably added to the aqueous dispersion to adjust the pH thereof to 6.5 or lower, thereby converting the colloid to a water-soluble substance. As the acid added, may be used an inorganic acid such as sulfuric acid, hydrochloric acid or nitric acid; or an organic acid such as formic acid or acetic acid. However, sulfuric acid is particularly preferred because of its high removing efficiency and small burden on production equipment.

No particular limitation is imposed on a dehydration and filtration method, and various publicly known methods may be used. As examples thereof, may be mentioned a centrifugal filtration method, a vacuum filtration method and a pressure filtration method. It is preferable to conduct washing with water repeatedly between dehydration and filtration in that impurities and unreacted reactant(s) are removed. No particular limitation is also imposed on a drying method, and various methods may be applied.

When the colored resin particles are produced in accordance with the pulverization process, the production is conducted by the following process. First, a binder resin, a colorant and optional additives such as a parting agent and a charge control agent are mixed by means of a ball mill, V-type mixer, HENSCHEL MIXER, high-speed dissolver, internal mixer, fall berg or the like. The mixture obtained by the mixing is then kneaded by means of a pressure kneader, twin-screw extrusion kneader, roller or the like while heating it. The resultant kneaded product is roughly pulverized by means of a pulverizer such as a hammer mill, cutter mill or roll mill. The roughly pulverized product is further finely pulverized by means of a pulverizer such as a jet mill or high-speed rotating type pulverizer and then classified into a desired particle diameter by a classifier such as an air classifier or airborne classifier. In such a manner, the colored resin particles are obtained by the pulverization process. As the colorant and the optional additives such as the parting agent and charge control agent, which are used in the pulverization process, may be used those mentioned in the above-described polymerization process.

The colored resin particles obtained by the pulverization process may also be provided as core-shell type colored resin particles according to the process such as the in-situ polymerization process like the colored resin particles obtained by the above-described polymerization process.

The colored resin particles are obtained by the polymerization process or pulverization process in accordance with the above-described process.

The volume average particle diameter Dv of the colored resin particles (including core-shell type colored resin particles) is preferably 3 to 15 μm, more preferably 4 to 12 μm. If the Dv is less than this range, the flowability of the resulting toner is lowered, so that such a toner shows a tendency to lower transferability, cause blur or lower an image density. If the Dv exceeds this range, the resulting toner shows a tendency to deteriorate the resolution of an image formed with such a toner.

A ratio (Dv/Dp) of the volume average particle diameter (Dv) of the colored resin particles to the number average particle diameter (Dp) thereof is preferably 1.00 to 1.30, more preferably 1.00 to 1.20. If the Dv/Dp exceeds this range, the resulting toner shows a tendency to cause blur or lower transferability, image density and resolution.

The spheroidicity (Sc/Sr) of the colored resin particles is preferably 1.00 to 1.30, more preferably 1.00 to 1.20. If the spheroidicity (Sc/Sr) exceeds such a range, the resulting toner shows a tendency to lower transferability and flowability or easily cause blur. The spheroidicity (Sc/Sr) of the colored resin particles is determined by the following method. The colored resin particles are photographed by an electron microscope, and the resultant photograph is processed by means of an image processing analyzer (manufactured by NIRECO Corporation, trade name "LUZEX IID") under conditions of an area rate of particles to a frame area of 2% in maximum and a total processing number of 100 particles to measure a spheroidicity of each of the colored resin particles. The resultant spheroidicity values of the 100 colored resin particles are averaged to regard the average value thereof as a spheroidicity (Sc/Sr) of the colored resin particles. Here, Sc is an area of a circle supposing that the absolute maximum length of a colored resin particle is a diameter, and Sr is a substantial projected area of the colored resin particle.

(5) External Additive

The toner according to the present invention comprises the colored resin particles and the external additive. The charging properties, flowability, shelf stability and the like of the toner are controlled by adding the external additive. The addition of the external additive can be conducted by stirring and mixing the colored resin particles and the external additive by a high-speed stirring machine.

The toner for development of electrostatic images composed of the colored resin particles and the external additive is called a one-component developer, and this one-component developer is classified into a nonmagnetic one-component developer and a magnetic one-component developer according to whether the colored resin particles have magnetism or not. Carrier particles such as ferrite or iron powder are further mixed with a mixture of the colored resin particles and the external additive, thereby obtaining a two-component developer. This two-component developer is classified into a nonmagnetic two-component developer and a magnetic two-component developer according to whether the colored resin particles have magnetism or not. Magnetic substance powder is caused to be contained in the colored resin particles, whereby magnetism can be imparted to the colored resin particles. The toner for development of electrostatic images according to the present invention is preferably a nonmagnetic one-component developer.

The addition of the external additive can be conducted by stirring and mixing the colored resin particles and the external additive by a high-speed stirring machine, thereby causing the external additive to adhere to the surfaces of the colored resin particles. Examples of the high-speed stirring machine include HENSCHEL MIXER (trade name, manufactured by MITSUI MINING COMPANY, LIMITED), SUPERMIXER (trade name, manufactured by KAWATA MFG Co., Ltd.), Q MIXER (trade name, manufactured by MITSUI MINING COMPANY, LIMITED), MECHANOFUSION SYSTEM (trade name, manufactured by Hosokawa Micron Corporation) and MECHANOMILL (trade name, manufactured by OKADA SEIKO CO., LTD.).

In the toner for development of electrostatic images according to the present invention, any other external additive may be used in combination in addition to the specified external additive (fine particles of an inorganic layered clay compound). When two or more external additives are used in combination, the colored resin particles and all the external additives may be placed in the high-speed stirring machine to stir and mix them. However, it is preferable to adopt a method, in which the colored resin particles and only an external additive having a larger particle diameter are placed in the high-speed stirring machine and stirred and mixed, and an external additive having a smaller particle diameter is then further added to stir and mix them.

In the present invention, fine particles of an inorganic layered clay compound with a quaternary ammonium ion intercalated between layers thereof or fine particles of an inorganic layered clay compound having an interlayer distance of 1.5 to 4 nm are used as the external additive.

Examples of the inorganic layered clay compound include a kaolin group including kaolinite, dickite, halloysite and lizerdite; a smectite group including montmorillonite, beidellite, nontronite, hectorite and saponite; a mica group including phlogopite, biotite, muscovite, paragonite and sericite; a chlorite group including clinochlore, chamosite, pennantite and donbassite; and a talc-pyrophyllite group including talc, willemseite, kerolite and pyrophyllite.

Among these, the smectite group including montmorillonite, beidellite, nontronite, hectorite and saponite is preferred, with bentonite, which is a clay comprising montmorillonite as a main component, being more preferred.

The inorganic layered clay compound is a layered compound, and a metal cation of an alkali metal or alkaline earth metal is generally present between planar macromolecular layers making up this layered compound. These metal cations are known to be weak in bonding to the portion of the macromolecular layers and to cause a cation interchange reaction when they come into contact with a solution containing cations different therefrom. A reaction that a different ion, molecule or atom is inserted between layers of the layered compound is called "intercalation". A compound formed by intercalating another ion or the like between layers of the layered compound is referred to as an intercalation compound.

A process for conducting the intercalation in the present invention includes a process comprising dispersing fine particles of the inorganic layered clay compound in an aqueous medium such as a lower alcohol or water, adding a quaternary ammonium salt to the resultant aqueous dispersion and then heating the dispersion under stirring. For example, a device capable of strongly stirring, such as an in-line type emulsifying and dispersing machine (manufactured by Ebara Corporation, trade name "MILDER") or a high-speed emulsifying and dispersing machine (manufactured by Tokushu Kika Kogyo Co., Ltd., trade name "T.K. HOMOMIXER MARK II"), is preferably used in this stirring.

Examples of the quaternary ammonium salt used in the intercalation include those respectively having a tetraalkylammonium cation, an ammonium cation having both benzyl group and alkyl group and a pyridinium cation. Examples of an anion making up these quaternary ammonium salts include a hydroxyl ion, halide ions (fluoride ion, chloride ion, bromide ion and iodide ion), a nitrate ion, a nitrite ion and a methosulfate ion. Among these, the chloride ion is preferred.

As the tetraalkylammonium cation is preferred a tetraalkylammonium cation having alkyl groups each having 1 to 22 carbon atoms. Specific examples of quaternary ammonium salts having such a tetraalkylammonium cation include lauryltrimethylammonium chloride, dilauryl-dimethylammonium chloride, didecyldimethylammonium chloride, cetyltrimethylammonium chloride, dimethyl-dioctylammonium bromide, trimethylstearylammonium bromide, dimethyldistearylammonium chloride, cetyltrimethylammonium methosulfate, stearamidoethyldiethylmethylammonium methosulfate and laurylamidoethyldiethylmethylammonium methosulfate.

Examples of the ammonium cation having both benzyl group and alkyl group include ammonium cations having a benzyl group and alkyl groups each having 1 to 22 carbon atoms. Examples of ammonium salts having such a cation include benzyllauryldimethylammonium chloride (benzalkonium chloride) and benzyldimethyloctylammonium methosulfate.

Examples of the pyridinium cation include pyridinium cations having an alkyl group having 8 to 22 carbon atoms. Specific examples of quaternary ammonium salts having such a pyridinium cation include N-cetylpyridinium chloride, N-oleylpyridinium chloride, N-laurylpyridinium chloride and N-laurylpyridinium methosulfate.

In the present invention, the inorganic layered clay compound is preferably subjected to a hydrophobilizing treatment. As a hydrophobilizing agent, may be used, for example, a silane coupling agent, silicone oil, fatty acid or fatty acid metal salt. Among these, the silane coupling agent and silicone oil are preferred. Examples of the silane coupling agent include disilazanes such as hexamethyldisilazane; cyclic silazanes; alkylsilane compounds such as trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxy-silane and vinyltriacetoxysilane; and aminosilane compounds such as γ-aminopropyltriethoxysilane, γ-(2-aminoethyl)-aminopropyltrimethoxysilane, γ-(2-aminoethyl)aminopropyl-methyldimethoxysilane, N-phenyl-3-aminopropyltrimethoxy-silane and N-(2-aminoethyl)-3-aminopropyltrimethoxysilane, N-β-(N-vinylbenzylaminoethyl)-γ-aminopropyltrimethoxysilane.

Examples of the silicone oil include dimethyl polysiloxane, methyl hydrogenpolysiloxane, methylphenyl polysiloxane and amino-modified silicone oil.

These hydrophobilizing agents may be used either singly or in any combination thereof. Silicone oil and a silane coupling agent are preferably used as the hydrophobilizing agent because the quality of an image formed by the resulting toner is improved. An amino group-containing compound such as an aminosilane compound or amino-modified silicone oil is more preferably used as the hydrophobilizing agent because a toner having good positive charge property is easy to be provided.

In the present invention, as a process for hydrophobilizing the fine particles of the inorganic layered clay compound, may be used a general process, and a dry process and a wet process may be mentioned. Specific examples thereof include a process, in which the hydrophobilizing agent is added dropwise or sprayed while stirring the fine particles at high speed; and a process, in which the fine particles are added into a solution with the hydrophobilizing agent dissolved in an organic solvent while stirring the solution. The hydrophobilizing treatment is preferably conducted after the intercalation of the quaternary ammonium ion.

In the present invention, the number average particle diameter of the fine particles of the inorganic layered clay compound used in the intercalation is generally 0.1 to 10 μm, preferably 0.1 to 3 μm, more preferably 0.2 to 2 μm, particularly preferably 0.3 to 1.5 μm. The number average particle diameter of the fine particles of the inorganic layered clay compound is substantially not changed even by the intercalation of the quaternary ammonium ion.

The amount of the fine particles of the inorganic layered clay compound added is preferably 0.05 to 2 parts by weight, more preferably 0.05 to 1 part by weight, particularly preferably 0.1 to 0.5 parts by weight per 100 parts by weight of the colored resin particles.

The fine particles of the inorganic layered clay compound with the quaternary ammonium ion intercalated therein are used as the external additive, whereby a toner for development of electrostatic images, which is excellent in printing durability not only under a normal-temperature and normal-humidity environment but also under a high-temperature and high-humidity environment and does not cause fog in a wide charge level range of the toner, can be provided.

In the present invention, fine particles of an inorganic layered clay compound, whose interlayer distance is 1.5 to 4 nm, may be used as an external additive. The fine particles of the inorganic layered clay compound, whose interlayer distance is 1.5 to 4 nm, are used as the external additive, whereby a toner for development of electrostatic images, which is improved in toner properties and hard to cause fog even when printing is conducted on a large number of sheets of paper in particular, and moreover is hard to cause blur in solid printing, can be provided. In the present invention, the interlayer distance of the inorganic layered clay compound is preferably 1.8 to 3.5 nm.

The interlayer distance of the inorganic layered clay compound can be easily determined from a peak of an angle (2θ) of X-ray diffraction in the (001) surface appeared in a wide angle X-ray diffraction chart in accordance with an X-ray diffraction method using an X-ray diffractometer (for example, trade name "RINT2500", manufactured by Rigaku Corporation).

In the inorganic layered clay compound, a cation of an alkali metal or alkaline earth metal is present between layers thereof, and in the inorganic layered clay compound, whose interlayer distance is 1.5 to 4 nm, the metal cation present between the layers is preferably interchanged with another guest cation by intercalation. The interlayer distance can be controlled by changing intercalation conditions such as the kind of the guest cation intercalated and temperature, a drying method after the reaction, and the like.

A process for conducting the intercalation includes the same process as described above. The fine particles of the inorganic layered clay compound are first dispersed in an aqueous medium such as a lower alcohol or water, a salt of a cation to become a guest cation is added to the resultant aqueous dispersion, and the dispersion is then heated under stirring to conduct intercalation. The resultant dispersion of the fine particles of the thus-intercalated inorganic layered clay compound is cooled, dehydrated and then dried, thereby obtaining fine particles of an inorganic layered clay compound intercalated.

Examples of the cation to become the guest cation include quaternary ammonium ions, phosphonium ions and imidazolium ions. Among these, the quaternary ammonium ions are preferred because the effects of the present invention are easily achieved.

With respect to the intercalation of the quaternary ammonium ion, the above-described process can be adopted. The inorganic layered clay compound, whose interlayer distance is 1.5 to 4 nm, is preferably subjected to the hydrophobilizing treatment in the same manner as described above. The amount of the inorganic layered clay compound, whose interlayer distance is 1.5 to 4 nm, to be added is also in the same range as described above.

In the present invention, (A) fine particles having a number average primary particle diameter of 3 to 18 nm and (B) fine particles having a number average primary particle diameter of 20 to 200 nm are preferably used as external additives in addition to the fine particles of the inorganic layered clay compound (intercalation compound) with a quaternary ammonium ion intercalated between layers thereof or the fine particles of the inorganic layered clay compound, whose interlayer distance is 1.5 to 4 nm. The fine particles (A) and fine particles (B) are, independently of each other, selected from fine particles of silica and titanium oxide (titania).

The number average primary particle diameter of the fine particles (A) is 3 to 18 nm, preferably 5 to 15 nm. When the number average primary particle diameter of the fine particles (A) falls within this range, the resulting toner has good flowability to provide good printed images free of blur. The fine particles (A) are preferably subjected to a hydrophobilizing treatment by treating the surfaces thereof with a hydrophobilizing agent.

The number average primary particle diameter of the fine particles (B) is 20 to 200 nm, preferably 25 to 100 nm. When the number average primary particle diameter of the fine particles (B) falls within this range, a toner scarcely causing fog can be provided. With respect to printing durability, the effect by the fine particles of the inorganic layered clay compound according to the present invention is easy to be achieved.

The fine particles (A) and the fine particles (B) are also preferably subjected to a hydrophobilizing treatment. The hydrophobilizing agent and the process for the hydrophobilizing treatment are the same as those in the fine particles of the inorganic layered clay compound.

The amount of the fine particles (A) added is preferably 0.1 to 3 parts by weight, more preferably 0.3 to 1.5 parts by weight per 100 parts by weight of the colored resin particles. The amount of the fine particles (B) added is preferably 0.1 to 3 parts by weight, more preferably 0.3 to 2 parts by weight per 100 parts by weight of the colored resin particles.

In the present invention, other fine particles may be further added as an external additive as needed. Examples of such an external additive include inorganic fine particles such as aluminum oxide, zinc oxide, tin oxide, calcium carbonate, calcium phosphate and cerium oxide; and organic resin particles such as particles of methacrylic ester polymers, acrylic ester polymers, styrene-methacrylic ester copolymers, styrene-acrylic ester copolymers and melamine resins, and core-shell type particles in which the core is formed by a styrene polymer, and the shell is formed by a methacrylic ester polymer.

When other fine particles are externally added, the added amount is preferably 0.1 to 3 parts by weight, more preferably 0.2 to 2 parts by weight per 100 parts by weight of the colored resin particles.

The toner for development of electrostatic images according to the present invention is excellent in printing durability not only under a normal-temperature and normal-humidity environment but also under a high-temperature and high-humidity environment and is hard to cause fog in a wide charge level range of the toner.

The toner for development of electrostatic images according to the present invention is a toner, which is hard to cause fog even when printing is conducted on a large number of sheets of paper, and moreover is hard to cause blur and excellent in printing durability.

EXAMPLES

The present invention will hereinafter be described in more detail by the following Preparation Examples, Examples and Comparative Examples. However, the present invention is not limited to the following examples only. Incidentally, all designations of "part" or "parts" and "%" as will be used in the following examples mean part or parts by weight and % by weight unless expressly noted. The testing methods of physical properties and properties are as follows.

(1) Volume Average Particle Diameter and Particle Diameter Distribution:

The volume average particle diameter (Dv) and particle diameter distribution represented by a ratio (Dv/Dp) of the volume average particle diameter (Dv) to the number average particle diameter (Dp) of colored resin particles were measured by means of a MULTISIZER (manufactured by Beckmann Coulter Co). The measurement by the MULTISIZER was conducted under conditions of an aperture diameter=100 μm, a medium=ISOTHONE II, a concentration=10% and the number of particles measured=100,000 particles.

(2) Spheroidicity:

The spheroidicity (Sc/Sr) of each of colored resin particles is determined by processing an electron microphotograph of the colored resin particles by means of an image processing analyzer (manufactured by NIRECO Corporation, trade name "LUZEX IID") under conditions of an area rate of particles to a frame area of 2% in maximum and a total processing number of 100 particles. Here, Sc is an area of a circle supposing that the absolute maximum length of a colored polymer particle is a diameter, and Sr is a substantial projected area of the colored polymer particle. The thus-obtained spheroidicities (Sc/Sr) of the 100 colored resin particles are averaged to calculate out an average value thereof. This average value is regarded as the spheroidicity (Sc/Sr) of the colored resin particles.

(3) Number Average Primary Particle Diameter:

The number average primary particle diameters of fine particles of an inorganic layered clay compound and fine particles of an external additive are values obtained by the following method. Electron microphotographs of the respective fine particles were taken. Each of the electron microphotographs was processed by means of an image processing analyzer (manufactured by NIRECO Corporation, trade name "LUZEX IID") under conditions of an area rate of particles to a frame area of 2% in maximum and a total processing number of 100 particles to calculate out a diameter of a circle corresponding to a projected area of each fine particle, thereby obtaining an arithmetic mean value of the fine particles. This arithmetic mean value was regarded as a number average primary particle diameter.

(4) Interlayer Distance of Inorganic Layered Clay Compound:

An inorganic layered clay compound was subjected to X-ray diffraction by means of an X-ray diffractometer (manufactured by Rigaku Corporation, trade name "RINT2500") under conditions of a voltage of 40 kV, a current of 300 mA and a measuring angle (2θ) of 2 to 600. An interlayer distance was determined from a peak of an angle (2θ) of X-ray diffraction in the (001) surface appeared in a wide angle X-ray diffraction chart thus obtained.

(5) Printing Durability (NN Environment and HH Environment):

Paper for printing was set in a commercially available printer of a nonmagnetic one-component development system, and a toner was placed in a development unit thereof. After the printer was left to stand for 24 hours under a normal-temperature and normal-humidity (NN) environment of 23° C. in temperature and 50% in relative humidity (RH), continuous printing was conducted under the same NN environment at an image density of 5%.

Solid printing (image density: 100%) was conducted every 500 paper sheets in the continuous printing to measure an image density of a solid-printed area by means of a reflection type image densitometer (manufactured by McBeth Co., trade name: RD918). Thereafter, white solid printing (image density: 0%) was conducted, and the printer was stopped in the middle of the white solid printing. A toner remaining in a non-image area on a photosensitive member after development was caused to adhere to a pressure-sensitive adhesive tape (product of Sumitomo 3M Limited, trade name: SCOTCH MENDING TAPE 810-3-18), and this pressure-sensitive adhesive tape was stuck on paper for printing. A whiteness degree (B) of the paper for printing, on which the pressure-sensitive adhesive tape had been stuck, was then measured by means of a whiteness meter (manufactured by Nippon Denshoku K.K.). Only an unused pressure-sensitive adhesive tape was stuck on paper for printing to measure a whiteness degree (A) thereof likewise. A difference (B−A) between these whiteness degrees was regarded as a fog value (%). The smaller fog value indicates that fog is less, and image quality is better.

The number of paper sheets, on which the continuous printing could be conducted while retaining such image quality that the image density is 1.3 or higher, and the fog value is 3% or lower, was determined to regard such number of paper sheets as the number of paper sheets that passed the printing durability test under the NN environment.

The number of paper sheets that passed the printing durability test under a high-temperature and high-humidity (HH)

environment was determined in the same manner as described above except that the NN environment was changed to the HH environment of 30° C. in temperature and 80% in RH to conduct the printing durability test.

The test was carried out until the number of paper sheets subjected to the continuous printing amounted to 15,000 sheets. In the test results shown in Table 1, "15,000<" indicates that the evaluation standard was satisfied even when the continuous printing was conducted on 15,000 paper sheets.

(6) Charge Level of Toner at the End of Printing Durability Test (NN Environment):

At the time fog occurred in the above-described printing durability test under the NN environment in (5), and so the printing durability test was ended, a charge level (μC/g) of the toner attached to the surface of a developing roll was measured by means of a suction type charge level meter (manufactured by TREK JAPAN K.K., trade name "210HS-2A"). In the test results shown in Table 1, "15,000<" indicates that the charge level of the toner was measured at the time the printing durability test was ended at the 15,000-th paper sheet.

(7) Printing Durability (Paper Sheets Printed Up to Occurrence of Fog)

In the above-described printing durability test under the NN environment described in (5), solid printing (image density: 100%) was conducted every 1,000 paper sheets in the continuous printing in place of every 500 paper sheets, and white solid printing (image density: 0%) was then conducted. The above-described difference (B−A) in whiteness degree was regarded as a fog value (%).

The number of paper sheets, on which the continuous printing could be conducted while retaining such image quality that the fog value is 3% or lower, was determined, and the number of paper sheets printed up to the time the image quality could not be retained was regarded as the number of paper sheets printed up to occurrence of fog.

The continuous printing was conducted up to the time fog occurred while measuring the fog value every 1,000 paper sheets, and the test was carried out until the number of paper sheets subjected to the continuous printing amounted to 15,000 sheets. In the test results shown in Table 2, "15,000<" indicates that the evaluation standard was satisfied even when the continuous printing was conducted on 15,000 paper sheets.

(8) Printing Durability (Paper Sheets Printed Up to Occurrence of Blur)

An image obtained by solid printing (image density: 100%) every 1,000 paper sheets in the above-described printing durability in (7) was visually observed to regard the number of paper sheets continuously printed up to the time blur occurred in the image as the number of paper sheets printed up to occurrence of blur. In the test results shown in Table 2, "15,000<" indicates that no blur occurred even when the continuous printing was conducted on 15,000 paper sheets.

Preparation Example 1

After 150 parts of bentonite having a number average primary particle diameter of 0.5 μm was placed in 1,500 parts of ion-exchanged water and dispersed therein, 15 parts of dimethyldistearylammonium chloride (quaternary ammonium salt) was added. After the resultant dispersion was then heated to 80° C., the dispersion was stirred for 1 hour by means of a high-speed emulsifying and dispersing machine (manufactured by Tokushu Kika Kogyo Co., Ltd., trade name "T.K. HOMOMIXER MARK II"). After solids obtained by filtration were washed repeatedly with deionized water, the solids were dehydrated and then dried for 24 hours at 60° C. by a vacuum dryer to obtain fine particles No. 1 of an inorganic layered clay compound (intercalation compound). The number average primary particle diameter of the fine particles No. 1 of the inorganic layered clay compound was 0.5 μm.

Preparation Example 2

The fine particles No. 1 of the inorganic layered clay compound obtained in Preparation Example 1 was subjected to a hydrophobilizing treatment according to the following process to obtain fine particles No. 2 of an inorganic layered clay compound (intercalation compound subjected to hydrophobilizing treatment). The number average primary particle diameter of the fine particles No. 2 of the inorganic layered clay compound was 0.5 μm.

After 100 g of the fine particles No. 1 of the inorganic layered clay compound were placed in a container, 16 g of gasified N-phenyl-3-aminopropyltrimethoxysilane (amino group-containing silane coupling agent, product of Shin-Etsu Chemical Co., Ltd., trade name "KBM-573") was introduced thereinto by accompanying nitrogen to bring the fine particles No. 1 of the inorganic layered clay compound into contact with the gasified amino group-containing silane coupling agent, thereby conducting the hydrophobilizing treatment.

Preparation Example 3

Fine particles of an inorganic layered clay compound with a laurylpyridinium (quaternary ammonium ion) intercalated between layers thereof were obtained in the same manner as in Preparation Example 1 except that dimethyldistearylammonium chloride in Preparation Example 1 was changed to laurylpyridinium chloride. The fine particles of this inorganic layered clay compound were then subjected to a hydrophobilizing treatment in the same manner as in Preparation Example 2 to obtain fine particles No. 3 of an inorganic layered clay compound (intercalation compound) subjected to the hydrophobilizing treatment. The number average primary particle diameter of the fine particles No. 3 of the inorganic layered clay compound was 0.5 μm.

Preparation Example 4

Fine particles of an inorganic layered clay compound with a benzyllauryldimethylammonium (quaternary ammonium ion) intercalated between layers thereof were obtained in the same manner as in Preparation Example 1 except that dimethyldistearylammonium chloride in Preparation Example 1 was changed to benzyllauryldimethylammonium chloride. The fine particles of this inorganic layered clay compound were then subjected to a hydrophobilizing treatment in the same manner as in Preparation Example 2 to obtain fine particles No. 4 of an inorganic layered clay compound (intercalation compound) subjected to the hydrophobilizing treatment. The number average primary particle diameter of the fine particles No. 4 of the inorganic layered clay compound was 0.5 μm.

Preparation Example 5

Fine particles of an inorganic layered clay compound with a dimethyldistearylammonium (quaternary ammonium ion) intercalated between layers thereof were obtained in the same manner as in Preparation Example 1 except that the bentonite having a number average primary particle diameter of 0.5 μm in Preparation Example 1 was changed to kaolinite having a number average primary particle diameter of 1.0 μm. The fine particles of this inorganic layered clay compound were then subjected to a hydrophobilizing treatment in the same manner as in Preparation Example 2 to obtain fine particles No. 5 of an inorganic layered clay compound (intercalation compound) subjected to the hydrophobilizing treatment. The number average primary particle diameter of the fine particles No. 5 of the inorganic layered clay compound was 1.0 μm.

Preparation Example 6

The same kaolinite having a number average primary particle diameter of 1.0 μm as that used in Preparation Example 5 was subjected to a hydrophobilizing treatment in the same manner as in Preparation Example 2 without intercalating a quaternary ammonium ion as it is to obtain fine particles No. 6 of an inorganic layered clay compound subjected to the hydrophobilizing treatment. The number average primary particle diameter of the fine particles No. 6 of the inorganic layered clay compound was 1.0 μm.

Preparation Example 7

After 150 parts of bentonite having a number average primary particle diameter of 0.5 μm was placed in 1,500 parts of ion-exchanged water and dispersed therein, 20 parts of dimethyldistearylammonium chloride (quaternary ammonium salt) was added. After the resultant dispersion was then heated to 70° C., the dispersion was stirred for 1 hour by means of a high-speed emulsifying and dispersing machine (manufactured by Tokushu Kika Kogyo Co., Ltd., trade name "T.K. HOMOMIXER MARK II"). After solids obtained by filtration were washed repeatedly with deionized water, the solids were dehydrated and dried for 48 hours at 120° C. by a vacuum dryer to obtain fine particles of an inorganic layered clay compound (intercalation compound) with a dimethyldistearylammonium (quaternary ammonium ion) intercalated between layers thereof.

Then, the obtained fine particles of the inorganic layered clay compound were subjected to a hydrophobilizing treatment according to the following process.

After 100 parts of the fine particles of the inorganic layered clay compound were placed in a container, 16 parts of gasified N-phenyl-3-aminopropyltrimethoxysilane (amino group-containing silane coupling agent, product of Shin-Etsu Chemical Co., Ltd., trade name "KBM-573") was introduced thereinto by accompanying nitrogen to bring the fine particles of the inorganic layered clay compound into contact with the gasified amino group-containing silane coupling agent so as to react them, thereby obtaining fine particles No. 7 of an inorganic layered clay compound (intercalation compound) whose interlayer distance was 2.5 nm. The number average primary particle diameter of the fine particles No. 7 of the inorganic layered clay compound was 0.5 μm.

Preparation Example 8

After 150 parts of bentonite having a number average primary particle diameter of 0.4 μm was placed in 1,500 parts of ion-exchanged water and dispersed therein, 20 parts of dimethyldistearylammonium chloride (quaternary ammonium salt) was added. After the resultant dispersion was then heated to 90° C., the dispersion was stirred for 2 hours by means of a high-speed emulsifying and dispersing machine (manufactured by Tokushu Kika Kogyo Co., Ltd., trade name "T.K. HOMOMIXER MARK II"). After solids obtained by filtration were washed repeatedly with deionized water, the solids were dehydrated and dried for a week at 40° C. by an air dryer.

The fine particles of the inorganic layered clay compound obtained in this manner were subjected to a hydrophobilizing treatment in the same manner as in Preparation Example 7 to obtain fine particles No. 8 of an inorganic layered clay compound (intercalation compound) whose interlayer distance was 3.3 nm. The number average primary particle diameter of the fine particles No. 8 of the inorganic layered clay compound was 0.4 μm.

Preparation Example 9

Fine particles No. 9 of an inorganic layered clay compound subjected to a hydrophobilizing treatment were obtained in the same manner as in Preparation Example 7 except that dimethyldistearylammonium chloride in Preparation Example 7 was changed to dilauryldimethyl-ammonium chloride. The fine particles No. 9 of this inorganic layered clay compound were fine particles of an intercalation compound with a dilauryldimethylammonium (quaternary ammonium ion) intercalated between layers thereof, and the interlayer distance thereof was 2.0 nm. The number average primary particle diameter of the fine particles No. 9 of the inorganic layered clay compound was 0.5 μm.

Preparation Example 10

Fine particles No. 10 of an inorganic layered clay compound subjected to a hydrophobilizing treatment were obtained in the same manner as in Preparation Example 7 except that dimethyldistearylammonium chloride in Preparation Example 7 was changed to trimethylmyristyl-ammonium chloride. The fine particles No. 10 of this inorganic layered clay compound were fine particles of an intercalation compound with a trimethylmyristylammonium intercalated between layers thereof, and the interlayer distance thereof was 1.6 nm. The number average primary particle diameter of the fine particles No. 10 of the inorganic layered clay compound was 0.5 μm.

Preparation Example 11

Kaolinite having a number average primary particle diameter of 1.0 μm was subjected to a hydrophobilizing treatment in the same manner as in Preparation Example 7, thereby obtaining fine particles No. 11 of an inorganic layered clay compound. The fine particles No. 11 of the inorganic layered clay compound were fine particles of a compound intercalated with no quaternary ammonium ion, and the interlayer distance thereof was 1.1 nm. The number average primary particle diameter of the fine particles No. 11 of the inorganic layered clay compound was 1.0 μm.

Example 1

After 83 parts of styrene and 17 parts of n-butyl acrylate as monovinyl monomers (calculated Tg of the resulting copolymer=60° C.), 7 parts of carbon black (product of Mitsubishi Chemical Corporation, trade name: #25B) as a black colorant, 1 part of a charge control agent (positively chargeable charge control resin; quaternary ammonium salt group-containing styrene/acrylic resin, product of FUJIKURA KASEI CO., LTD., trade name "FCA-207P"), 0.6 parts of divinylbenzene as a crosslinkable monomer, 1.9 parts of t-dodecylmercaptan as a molecular weight modifier, and 0.25 parts of a polymethacrylic ester macromonomer (product of TOAG- OSEI Co., Ltd., trade name "AA6") as a macromonomer were mixed and stirred, the resultant mixture was wet-pulverized by means of a media type wet pulverizer. Five parts of dipentaerythritol hexamyristate as a parting agent was added to a composition obtained by the wet pulverization and dissolved therein to obtain a polymerizable monomer composition.

On the other hand, an aqueous solution with 6.2 parts of sodium hydroxide dissolved in 50 parts of ion-exchanged water was gradually added to an aqueous solution with 10.2 parts of magnesium chloride dissolved in 250 parts of ion-exchanged water under stirring to prepare a dispersion of magnesium hydroxide colloid (hardly water-soluble metal hydroxide colloid).

The polymerizable monomer composition obtained above was poured into the dispersion of magnesium hydroxide colloid obtained above, and the resultant mixture was stirred. After 6 parts of t-butyl peroxy-2-ethylhexanoate (product of NOF CORPORATION, trade name "PERBUTYL 0") as a polymerization initiator was added to the mixture, the resultant mixture was stirred under high shearing by means of an in-line type emulsifying and dispersing machine (manufactured by EBARA CORPORATION, trade name "EBARA MILDER") to form droplets of the polymerizable monomer composition.

A reactor was charged with the thus-obtained aqueous dispersion, in which the droplets of the polymerizable monomer composition had been dispersed, and the aqueous dispersion was heated to 90° C. to conduct a polymerization reaction. At the time a conversion into a polymer had reached almost 100%, a dispersion obtained by mixing 1 part of methyl methacrylate (polymerizable monomer for shell) and 10 parts of ion-exchanged water, and 0.3 parts of 2,2'-azobis [2-methyl-N-(2-hydroxyethyl)-propionamide] (polymerization initiator for shell; product of Wako Pure Chemical Industries, Ltd., trade name "VA-086") dissolved in 20 parts of ion-exchanged water were added to the reaction mixture. Thereafter, the temperature of 90° C. was kept for additionally 4 hours to continue the polymerization, and the reaction mixture was then cooled down to room temperature to obtain an aqueous dispersion containing colored resin particles formed.

Sulfuric acid was added to the thus-obtained aqueous dispersion of the colored resin particles to adjust the pH of the aqueous dispersion to 6.5 or lower, thereby conducting acid washing. After the aqueous dispersion was then dehydrated by filtration, water washing was conducted by a method of adding 500 parts of ion-exchanged water again to conduct re-slurrying. Thereafter, the dehydration and water washing were repeated several times likewise. After the resultant slurry was dehydrated by filtration, solids were placed in a container of a dryer and dried under conditions of a temperature of 45° C. and 48 hours to obtain dried colored resin particles (core-shell type colored polymer particles).

The volume average particle diameter (Dv) of the dried colored resin particles was 9.1 μm, the volume average particle diameter (Dv)/number average particle diameter (Dp) thereof was 1.14, and the spheroidicity (Sc/Sr) thereof was 1.12.

External additives were added into 100 parts of the colored resin particles thus obtained by a method of adding (A) 0.8 parts of fine silica particles (product of Clariant Co., trade name "HDK2150") subjected to a hydrophobilizing treatment and having a number average primary particle diameter of 12 nm as fine particles having a number average primary particle diameter of 3 to 18 nm, (B) 1 part of fine silica particles (product of NIPPON AEROSIL CO., LTD., trade name "NA50Y") subjected to a hydrophobilizing treatment and having a number average primary particle diameter of 30 nm as fine particles having a number average primary particle diameter of 20 to 200 nm and (C) 0.2 parts of the fine particles No. 2 of the inorganic layered clay compound obtained in Preparation Example 2 as fine particles of an inorganic layered clay compound, and mixing these components for 5 minutes under conditions of a peripheral speed of 30 m/sec by means of a high-speed stirrer (manufactured by MITSUI MINING COMPANY, LIMITED, trade name "HENSCHEL MIXER"), thereby preparing a toner for development of electrostatic images (nonmagnetic one-component developer). The composition and test results are shown in Table 1.

Example 2

A toner for development of electrostatic images was prepared in the same manner as in Example 1 except that the fine particles No. 2 of the inorganic layered clay compound in Example 1 were changed to the fine particles No. 1 of the inorganic layered clay compound obtained in Preparation Example 1. The composition and test results are shown in Table 1.

Example 3

A toner for development of electrostatic images was prepared in the same manner as in Example 1 except that the fine particles No. 2 of the inorganic layered clay compound in Example 1 were changed to the fine particles No. 3 of the inorganic layered clay compound obtained in Preparation Example 3. The composition and test results are shown in Table 1.

Example 4

A toner for development of electrostatic images was prepared in the same manner as in Example 1 except that the fine particles No. 2 of the inorganic layered clay compound in Example 1 were changed to the fine particles No. 4 of the inorganic layered clay compound obtained in Preparation Example 4. The composition and test results are shown in Table 1.

Example 5

A toner for development of electrostatic images was prepared in the same manner as in Example 1 except that the fine particles No. 2 of the inorganic layered clay compound in Example 1 were changed to the fine particles No. 5 of the inorganic layered clay compound obtained in Preparation Example 5. The composition and test results are shown in Table 1.

Comparative Example 1

A toner for development of electrostatic images was prepared in the same manner as in Example 1 except that the fine particles No. 2 of the inorganic layered clay compound in Example 1 were not used. The composition and test results are shown in Table 1.

Comparative Example 2

A toner for development of electrostatic images was prepared in the same manner as in Example 1 except that the fine particles No. 2 of the inorganic layered clay compound in Example 1 were changed to the fine particles No. 6 of the inorganic layered clay compound obtained in Preparation Example 6. The composition and test results are shown in Table 1.

TABLE 1

| | Example | | | | | Comp. Example | |
|---|---|---|---|---|---|---|---|
| | 1 | 2 | 3 | 4 | 5 | 1 | 2 |
| Colored resin particles | | | | | | | |
| Volume average particle diameter (μm) | 9.1 | 9.1 | 9.1 | 9.1 | 9.1 | 9.1 | 9.1 |
| Dv/Dp | 1.14 | 1.14 | 1.14 | 1.14 | 1.14 | 1.14 | 1.14 |
| Spheroidicity | 1.12 | 1.12 | 1.12 | 1.12 | 1.12 | 1.12 | 1.12 |
| External additive (parts) | | | | | | | |
| Fine silica particles (12 nm) | 0.8 | 0.8 | 0.8 | 0.8 | 0.8 | 0.8 | 0.8 |
| Fine silica particles (30 nm) | 1.0 | 1.0 | 1.0 | 1.0 | 1.0 | 1.0 | 1.0 |
| Fine particles of inorganic layered clay compound | 0.2 | 0.2 | 0.2 | 0.2 | 0.2 | — | 0.2 |
| Kind | Bentonite | Bentonite | Bentonite | Bentonite | Kaolinite | — | Kaolinite |
| Quaternary ammonium ion | a | a | b | c | a | — | Not contained |
| Hydrophobilizing treatment | Conducted | Not conducted | Conducted | Conducted | Conducted | — | Conducted |
| Number average primary particle diameter (μm) | 0.5 | 0.5 | 0.5 | 0.5 | 1.0 | — | 1.0 |
| Code | No. 2 | No. 1 | No. 3 | No. 4 | No. 5 | — | No. 6 |
| Printing durability | | | | | | | |
| NN environment | | | | | | | |
| Number of paper sheets that passed durability test | 15,000< | 15,000< | 15,000< | 15,000< | 12,000 | 5,000 | 8,000 |
| Charge level of toner at the end of the test (μC/g) | 5 | 6 | 8 | 8 | 10 | 18 | 15 |
| HH environment | | | | | | | |
| Number of paper sheets that passed durability test | 15,000< | 10,000 | 13,000 | 12,000 | 10,000 | 2,000 | 6,000 |

<Note>
a: Dimethyldistearylammonium ion
b: Laurylpyridinium ion
c: Benzyllauryldimethylammonium ion <Consideration>

The following facts are known from the test results shown in Table 1.

In the toner for development of electrostatic images of Comparative Example 1, in which fine particles of an inorganic layered clay compound with a quaternary ammonium ion intercalated therein were not used as an external additive, the image density was lowered and fog occurred after the printing was conducted on 5,000 paper sheets and 2,000 paper sheets, respectively, under the NN environment and the HH environment, and the charge level of the toner at this time was 18 μC/g.

In the toner for development of electrostatic images of Comparative Example 2, in which the fine particles No. 6 of the inorganic layered clay compound intercalated with no quaternary ammonium ion were used as an external additive, the results of the printing test were somewhat good compared with the toner of Comparative Example 1, but were yet insufficient.

On the other hand, the toners for development of electrostatic images of Examples 1 to 5, which contained, as an external additive, fine particles of an intercalation compound obtained by intercalating a quaternary ammonium ion between layers of an inorganic layered clay compound, exhibited excellent printing durability in both printing durability tests under the NN environment and the HH environment and were hard to cause fog even when the charge level of each toner became low.

Example 6

After 82 parts of styrene and 18 parts of n-butyl acrylate as monovinyl monomers, 7 parts of carbon black (product of Mitsubishi Chemical Corporation, trade name: #25B) as a black colorant, 1 part of a charge control agent (positively chargeable charge control resin; quaternary ammonium salt group-containing styrene/acrylic resin, product of FUJIKURA KASEI CO., LTD., trade name "FCA-207P"), 0.6 parts of divinylbenzene as a crosslinkable monomer, 1.9 parts of t-dodecylmercaptan as a molecular weight modifier, and 0.25 parts of a polymethacrylic ester macromonomer (product of TOAGOSEI CO., LTD., trade name "AA6") as a macromonomer were mixed and stirred, the resultant mixture was wet-pulverized by means of a media type wet pulverizer. Five parts of dipentaerythritol hexamyristate as a parting agent was added to a composition obtained by the wet pulverization and dissolved therein to obtain a polymerizable monomer composition.

On the other hand, an aqueous solution with 6.2 parts of sodium hydroxide dissolved in 50 parts of ion-exchanged water was gradually added to an aqueous solution with 10.2 parts of magnesium chloride dissolved in 250 parts of ion-exchanged water under stirring to prepare a dispersion of magnesium hydroxide colloid (hardly water-soluble metal hydroxide colloid).

The polymerizable monomer composition obtained above was poured into the dispersion of magnesium hydroxide colloid obtained above, and the resultant mixture was stirred. After 5.5 parts of t-butyl peroxy-2-ethylhexanoate (product of NOF CORPORATION, trade name "PERBUTYL 0") as a polymerization initiator was added to the mixture, the resultant mixture was stirred under high shearing by means of an in-line type emulsifying and dispersing machine (manufactured by EBARA CORPORATION, trade name "EBARA MILDER") to form droplets of the polymerizable monomer composition.

A reactor was charged with the thus-obtained aqueous dispersion, in which the droplets of the polymerizable monomer composition had been dispersed, and the aqueous dispersion was heated to 90° C. to conduct a polymerization reaction. At the time a conversion into a polymer had reached almost 100%, a dispersion obtained by mixing 1 part of methyl methacrylate (polymerizable monomer for shell) and 10 parts of ion-exchanged water, and 0.3 parts of 2,2'-azobis [2-methyl-N-(2-hydroxyethyl)-propionamide] (polymerization initiator for shell; product of Wako Pure Chemical Industries, Ltd., trade name "VA-086") dissolved in 20 parts of ion-exchanged water were added to the reaction mixture. Thereafter, the temperature of 90° C. was kept for additionally 4 hours to continue the polymerization, and the reaction mixture was then cooled down to room temperature to obtain an aqueous dispersion containing colored resin particles formed.

Sulfuric acid was added to the thus-obtained aqueous dispersion of the colored resin particles to adjust the pH of the aqueous dispersion to 6.5 or lower, thereby conducting acid washing. After the aqueous dispersion was then dehydrated by filtration, water washing was conducted by a method of adding 500 parts of ion-exchanged water again to conduct re-slurrying. Thereafter, the dehydration and water washing were repeated several times likewise. After the aqueous dispersion was dehydrated by filtration, solids were placed in a container of a dryer and dried under conditions of a temperature of 45° C. and 48 hours to obtain dried colored resin particles (core-shell type colored polymer particles). The volume average particle diameter (Dv) of the dried colored resin particles was 9.0 μm, the volume average particle diameter (Dv)/number average particle diameter (Dp) thereof was 1.15, and the spheroidicity (Sc/Sr) thereof was 1.13.

External additives were added into 100 parts of the colored resin particles thus obtained by a method of adding (A) 0.8 parts of fine silica particles (product of Clariant Co., trade name "HDK2150") subjected to a hydrophobilizing treatment and having a number average primary particle diameter of 12 nm as fine particles having a number average primary particle diameter of 3 to 18 nm, (B) 1 part of fine silica particles (product of NIPPON AEROSIL CO., LTD., trade name "NA50Y") subjected to a hydrophobilizing treatment and having a number average primary particle diameter of 30 nm as fine particles having a number average primary particle diameter of 20 to 200 nm and (C) 0.2 parts of the fine particles No. 7 of the inorganic layered clay compound obtained in Preparation Example 7 as fine particles of an inorganic layered clay compound, and mixing these components for 5 minutes under conditions of a peripheral speed of 30 m/sec by means of a high-speed stirrer (manufactured by MITSUI MINING COMPANY, LIMITED, trade name "HENSCHEL MIXER"), thereby preparing a toner for development of electrostatic images (nonmagnetic one-component developer). The composition and test results are shown in Table 2.

Example 7

A toner for development of electrostatic images was prepared in the same manner as in Example 6 except that the fine particles No. 7 of the inorganic layered clay compound in Example 6 were changed to the fine particles No. 8 of the inorganic layered clay compound obtained in Preparation Example 8. The composition and test results are shown in Table 2.

Example 8

A toner for development of electrostatic images was prepared in the same manner as in Example 6 except that the fine particles No. 7 of the inorganic layered clay compound in Example 6 were changed to the fine particles No. 9 of the inorganic layered clay compound obtained in Preparation Example 9. The composition and test results are shown in Table 2.

Example 9

A toner for development of electrostatic images was prepared in the same manner as in Example 6 except that the fine particles No. 7 of the inorganic layered clay compound in Example 6 were changed to the fine particles No. 10 of the inorganic layered clay compound obtained in Preparation Example 10. The composition and test results are shown in Table 2.

Comparative Example 3

A toner for development of electrostatic images was prepared in the same manner as in Example 6 except that the fine particles No. 7 of the inorganic layered clay compound in Example 6 were not used. The composition and test results are shown in Table 2.

Comparative Example 4

A toner for development of electrostatic images was prepared in the same manner as in Example 6 except that the fine particles No. 7 of the inorganic layered clay compound in Example 6 were changed to the fine particles No. 11 of the inorganic layered clay compound obtained in Preparation Example 11. The composition and test results are shown in Table 2.

TABLE 2

| | Example | | | | Comp. Example | |
|---|---|---|---|---|---|---|
| | 6 | 7 | 8 | 9 | 3 | 4 |
| Colored resin particles | | | | | | |
| Volume average particle diameter (μm) | 9.0 | 9.0 | 9.0 | 9.0 | 9.0 | 9.0 |
| Dv/Dp | 1.15 | 1.15 | 1.15 | 1.15 | 1.15 | 1.15 |
| Spheroidicity | 1.13 | 1.13 | 1.13 | 1.13 | 1.13 | 1.13 |
| External additive (parts) | | | | | | |
| Fine silica particles (12 nm) | 0.8 | 0.8 | 0.8 | 0.8 | 0.8 | 0.8 |
| Fine silica particles (30 nm) | 1.0 | 1.0 | 1.0 | 1.0 | 1.0 | 1.0 |
| Fine particles of inorganic layered clay compound | 0.2 | 0.3 | 0.2 | 0.2 | — | 0.2 |
| Kind | Bentonite | Bentonite | Bentonite | Bentonite | — | Kaolinite |

TABLE 2-continued

| | Example | | | | Comp. Example | |
|---|---|---|---|---|---|---|
| | 6 | 7 | 8 | 9 | 3 | 4 |
| Quaternary ammonium ion | d | d | e | f | — | Not contained |
| Hydrophobilizing treatment | Conducted | Conducted | Conducted | Conducted | — | Conducted |
| Interlayer distance (nm) | 2.5 | 3.3 | 2.0 | 1.6 | | 1.1 |
| Number average primary particle diameter (μm) | 0.5 | 0.4 | 0.5 | 0.5 | — | 1.0 |
| Code | No. 7 | No. 8 | No. 9 | No. 10 | — | No. 11 |
| Printing durability (NN environment) | | | | | | |
| Number of paper sheets printed up to occurrence of fog | 15,000< | 15,000< | 15,000< | 14,000 | 5,000 | 8,000 |
| Number of paper sheets printed up to occurrence of blur | 15,000< | 14,000 | 15,000 | 13,000 | 5,000 | 8,000 |

<Note>
d: Dimethyldistearylammonium ion
e: Dilauryldimethylammonium ion
f: Trimethylmyristylammonium ion <Consideration>

The following facts are known from the test results shown in Table 2.

In the toner for development of electrostatic images of Comparative Example 3, in which fine particles of an inorganic layered clay compound were not used as an external additive, fog and blur occurred at the time the continuous printing had been conducted on 5,000 paper sheets.

In the toner for development of electrostatic images of Comparative Example 4, in which the fine particles No. 11 of the inorganic layered clay compound, whose interlayer distance was as small as 1.1 nm, were used as an external additive, the results of the printing test were somewhat good compared with the toner of Comparative Example 3, but were yet insufficient, and fog and blur occurred at the time the continuous printing had been conducted on 8,000 paper sheets.

On the other hand, the toners for development of electrostatic images of Examples 6 to 9, which contained, as an external additive, fine particles of an inorganic layered clay compound, whose interlayer distance falls within a range of 1.5 to 4 nm, were hard to cause fog and blur in the printing durability test and exhibited excellent printing durability.

INDUSTRIAL APPLICABILITY

The toners for development of electrostatic images according to the present invention can be utilized for development of electrostatic images (electrostatic latent images) formed on a photosensitive member of an image forming apparatus of an electrophotographic system (including an electrostatic recording system), such as a copying machine, facsimile or printer.

The toners for development of electrostatic images according to the present invention were excellent in printing durability not only under a normal-temperature and normal-humidity environment but also under a high-temperature and high-humidity environment and were hard to cause fog in a wide charge level range of the toner.

The toners for development of electrostatic images according to the present invention were hard to cause fog even when printing is conducted on a large number of sheets of paper, and moreover were hard to cause blur and excellent in printing durability.

The invention claimed is:

1. A toner for development of electrostatic images, comprising colored resin particles containing a binder resin obtained by polymerizing a monovinyl monomer used as a main component of the polymerizable monomer, and a colorant, and an external additive, wherein (i) the external additive contains fine particles of an inorganic layered clay compound whose interlayer distance is 1.5 to 4 nm, (ii) the inorganic layered clay compound is an intercalation compound with a quaternary ammonium ion intercalated between layers of the inorganic layered clay compound, (iii) the fine particles of the inorganic layered clay compound have a number average primary particle diameter of 0.1 to 3 μm, and (iv) the surfaces of the fine particles of the inorganic layered clay compound are subjected to a hydrophobilizing treatment with a hydrophobilizing agent which is a silane coupling agent or silicone oil, and wherein the external additive further contains, in addition to the fine particles of the inorganic layered clay compound, (A) fine particles having a number average primary particle diameter of 3 to 18 nm, and (B) fine particles having a number average primary particle diameter of 20 to 200 nm, said fine particles (A) and (B) being, independently of each other, selected from the group consisting of fine silica particles and fine titanium dioxide particles.

2. The toner for development of electrostatic images according to claim 1, wherein the inorganic layered clay compound is a clay of a smectite group or kaolin group.

3. The toner for development of electrostatic images according to claim 2, wherein the clay of the smectite group is bentonite.

4. The toner for development of electrostatic images according to claim 1, wherein the fine particles of the inorganic layered clay compound have a number average primary particle diameter of 0.2 to 2 μm.

5. The toner for development of electrostatic images according to claim 1, wherein the quaternary ammonium ion is a tetraalkylammonium cation, an ammonium cation having both benzyl group and alkyl group or a pyridinium cation.

6. The toner for development of electrostatic images according to claim 1, wherein the fine particles of the inorganic layered clay compound are used in an amount of 0.05 to 2 parts by weight per 100 parts by weight of the colored resin particles.

7. The toner for development of electrostatic images according to claim 1, wherein the colored resin particles further contain a charge control resin.

* * * * *